US011476564B2

(12) United States Patent
Hoffman et al.

(10) Patent No.: US 11,476,564 B2
(45) Date of Patent: Oct. 18, 2022

(54) ANTENNA FOR AN END OF VEHICLE DEVICE

(71) Applicant: Westinghouse Air Brake Technologies Corporation, Wilmerding, PA (US)

(72) Inventors: Robert Hoffman, Germantown, MD (US); Padam Swar, Clarksburg, MD (US); Tim Gibson, Germantown, MD (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 87 days.

(21) Appl. No.: 16/730,681

(22) Filed: Dec. 30, 2019

(65) Prior Publication Data

US 2021/0203064 A1 Jul. 1, 2021

(51) Int. Cl.

| | |
|---|---|
| ***H01Q 1/32*** | (2006.01) |
| ***H01Q 1/12*** | (2006.01) |
| ***H01Q 1/18*** | (2006.01) |

(52) U.S. Cl.

CPC ..... *H01Q 1/3275* (2013.01); *H01Q 1/1207* (2013.01); *H01Q 1/18* (2013.01)

(58) Field of Classification Search

CPC ..... H01Q 1/3275; H01Q 1/1207; H01Q 1/18; H01Q 1/085; H01Q 1/3258; H01Q 1/088

See application file for complete search history.

(56) References Cited

U.S. PATENT DOCUMENTS

| | | | | |
|---|---|---|---|---|
| 4,238,800 | A | 12/1980 | Newington | |
| 4,692,770 | A * | 9/1987 | Kadokura | H01Q 1/3258 343/711 |
| 5,668,564 | A * | 9/1997 | Seward | H01Q 9/16 343/715 |
| 6,054,966 | A * | 4/2000 | Haapala | H01Q 1/242 343/749 |
| 6,509,878 | B1 * | 1/2003 | Tornatta, Jr. | H01Q 1/1214 343/715 |
| 2006/0022883 | A1 * | 2/2006 | Vincent | H01Q 9/30 343/722 |
| 2009/0073068 | A1 * | 3/2009 | Eide | H01Q 7/08 343/787 |
| 2009/0267847 | A1 * | 10/2009 | Sato | H01Q 9/0428 343/713 |
| 2011/0279337 | A1 * | 11/2011 | Corwin | H01Q 1/088 343/713 |
| 2014/0103185 | A1 * | 4/2014 | Miller | H01Q 1/085 248/615 |
| 2016/0240928 | A1 * | 8/2016 | Petajajarvi | H01Q 1/3275 |
| 2018/0159204 | A1 * | 6/2018 | Kim | H01Q 1/2291 |

* cited by examiner

*Primary Examiner* — Seokjin Kim

(74) *Attorney, Agent, or Firm* — The Small Patent Law Group LLC; Josef L. Hoffmann

(57) ABSTRACT

A system may be provided that may include an end of vehicle device, and an antenna coupled to an exterior of the end of vehicle device. The antenna may be configured to communicate signals to or from the end of vehicle device, and may include a conductive member configured to communicate the signals to or from the end of vehicle device, and a flexible support member disposed within the conductive member and configured to receive, absorb, and displace force from the conductive member.

20 Claims, 5 Drawing Sheets

ANTENNA FOR AN END OF VEHICLE DEVICE

BACKGROUND

Technical Field

The present disclosure relates to a system that includes an antenna for an end of vehicle device.

Discussion of Art

Certain vehicle systems include an end of vehicle device for communicating information related to the vehicle system to other portions of the vehicle system, and/or off board devices. For example, rail vehicle systems typically include a combination of propulsion vehicles, such as locomotives, and non-propulsion vehicles, such as cars. As a result, the rail vehicle systems can include numerous vehicles, where communication from the end of the vehicle device up to the head of the vehicle improves operation of the vehicle system.

The end of vehicle devices may include a transceiver that has an antenna for receiving and sending communication signals to and from the end of vehicle device. Often the antenna is within the end of vehicle device such that the housing may protect the antenna from the rough environment encountered by many vehicle systems.

High gain antennas may be used exterior to the end of the vehicle device. However, because of the rugged nature of most end of vehicle devices, the signal quality suffers in favor of antenna robustness. Additionally, the needed coupling strength for the end of vehicle device results in permanent fixtures that are difficult to replace. This results in significant maintenance time, and high maintenance costs.

BRIEF DESCRIPTION

In accordance with one embodiment, a system may be provided that may include an end of vehicle device. An antenna may be coupled to an exterior of the end of vehicle device and may be configured to communicate signals to or from the end of vehicle device. The antenna may include a conductive member configured to communicate the signals to or from the end of vehicle device, and a flexible support member disposed within the conductive member and configured to receive, absorb, and displace force from the conductive member.

In accordance with one embodiment, a method for forming an antenna may be provided that may include forming a conductive member with a hollow interior. The conductive member may be configured to provide a gain of a communication signal between zero decibels per isotropic radiator and twenty decibels per isotropic radiator. The method may also include inserting a flexible support member within the hollow interior of the conductive member. The flexible support member may be configured to receive, absorb, and displace force from the conductive member.

In accordance with one embodiment, a system may include an end of vehicle device that includes a transceiver. The system may also include an antenna coupled to the transceiver and configured to communicate signals of the transceiver to or from the end of vehicle device. The antenna may include a conductive member with a hollow interior that may be configured to communicate the signals to or from the end of vehicle device, and a flexible support member may be disposed within the hollow interior and engaging the conductive member. The modulus of elasticity of the flexible support member may be less than the modulus of elasticity of the conductive member.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to a high gain antenna that is removeably coupled to the exterior of an end of vehicle device. When used herein, gain, or antenna gain, refers to how well an antenna is converting input power into radio waves that are headed in a specific direction. The gain may also be considered the ratio of the power produced by the antenna from a far-field source on the antenna's beam axis to the power produced by a hypothetical lossless isotropic antenna that is equally sensitive to signals from all directions. In addition, the gain is considered the average gain of the antenna. The units of gain as referred herein are decibels-isotropic (dBi).

To address the rugged environment of the end of vehicle device, while also achieving a gain in a range between 0-20 dBi, a hollow conductive member is provided that has a flexible support member disposed therein. When used herein, flexible refers to any material having a modulus of elasticity for Young's modulus of less than ten Giga Pascals 10 GPa. In particular, the modulus of elasticity of the flexible support member is less than the modulus of elasticity of the conductive member. The flexible support member extends the length of the hollow conductive member and absorbs forces placed on the hollow conductive member. Upon receiving a force from the hollow conductive member, the flexible support member flexes accordingly to displace the force along the flexible support member. In this manner, the force does not damage the hollow conductive member through shearing or bending of the hollow conductive member material. Specifically, the resistance of the hollow conductive member to deformations, or kinking, of the cross section due to the flexible support member results in the antenna surviving in the conditions present in transportation systems, leading to increased life and decreased costs due to replacement.

Additionally, if replacement or repair is desired, the hollow conductive member additionally may be secured to a coupling element with a replaceable coupling such as a threaded exterior that may be matingly received by the threads of a corresponding threaded opening in the end of vehicle device. Therefore, when repair or replacement of the antenna is desired, the antenna may be quickly removed for maintenance, or replaced by another antenna.

Figure 1:
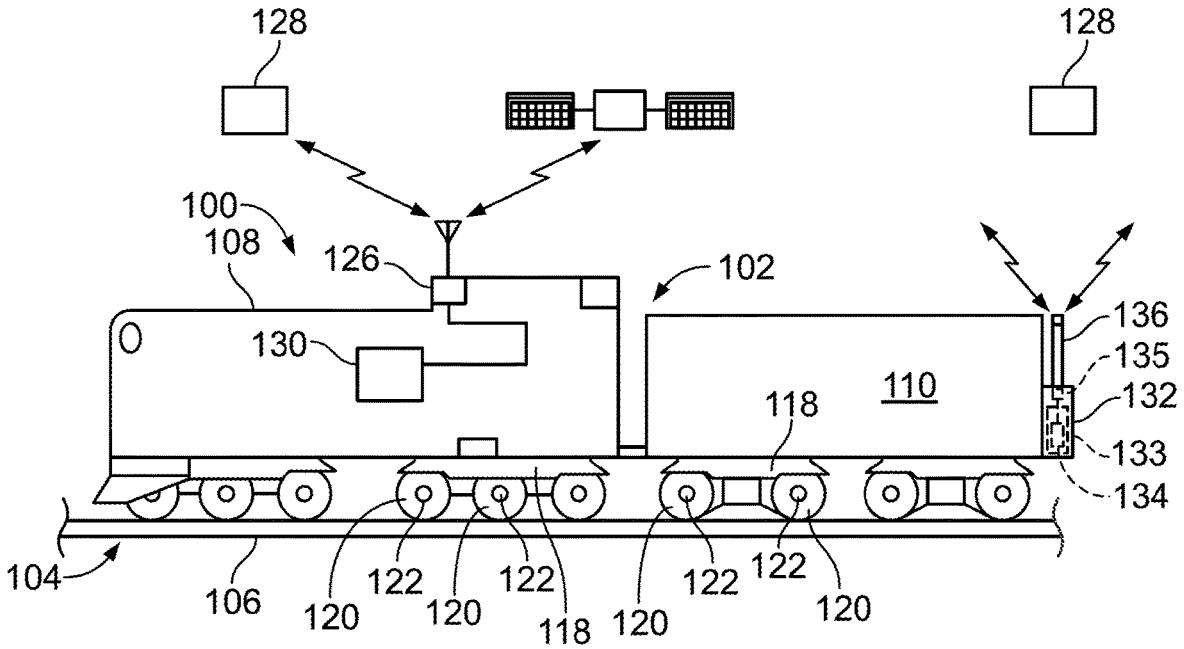
FIG. 1 illustrates a schematic view of a vehicle system.

FIG. 1 illustrates a schematic diagram of a control system 100 according to an embodiment. The control system is disposed on a vehicle system 102. The vehicle system is configured to travel along a route 104 on a trip from a starting or departure location to a destination or arrival location. The vehicle system includes one or more vehicles. For example, the vehicle system may include one or more propulsion-generating vehicles 108. Optionally, the vehicle system may include one or more non-propulsion-generating vehicles 110. In embodiments where the vehicle system includes two or more vehicles, the vehicles may be mechanically interconnected with each one. Alternatively, the vehicles of such a multi-vehicle vehicle system may not be mechanically coupled with each other. For example, the vehicles may be separate but logically coupled with each other by communicating with each other to move along one or more routes as a group (e.g., a convoy).

In one embodiment, the vehicle system may be a rail vehicle system, and the route may be a track formed by one or more rails. The propulsion vehicle may be a locomotive, and the car may be a rail car that carries passengers and/or cargo. Alternatively, the propulsion vehicle may be another type of rail vehicle other than a locomotive. In an alternative embodiment, the vehicle system may be one or more automobiles, marine vessels, aircraft, mining vehicles, agricultural vehicles, or other off-highway vehicles (OHV) system (e.g., a vehicle system that is not legally permitted and/or designed for travel on public roadways), or the like. While some examples provided herein describe the route as being a track, not all embodiments are limited to a rail vehicle traveling on a railroad track. One or more embodiments may be used in connection with non-rail vehicles and routes other than tracks, such as roads, paths, waterways, or the like.

The propulsion-generating vehicle includes a propulsion subsystem that generates tractive effort to propel the vehicle system. This propulsion subsystem can include components such as traction motors that propel the vehicle system. The propulsion-generating vehicle also can include a braking system that generates braking effort for the vehicle system to slow down or stop the vehicle system from moving. Optionally, the non-propulsion-generating vehicle includes a braking system but not a propulsion subsystem. The propulsion-generating vehicle is referred to herein as a propulsion vehicle, and the non-propulsion-generating vehicle is referred to herein as a car. Although one propulsion vehicle and one car are shown in FIG. 1, the vehicle system may include multiple propulsion vehicles and/or multiple cars. In an alternative embodiment, the vehicle system only includes the propulsion vehicle such that the propulsion vehicle is not coupled to the car or another kind of vehicle.

The control system controls the movements of the vehicle system. In one example, the control system is disposed entirely on the propulsion vehicle. In other embodiments, however, one or more components of the control system may be distributed among several vehicles, such as the vehicles that make up the vehicle system. For example, some components may be distributed among two or more propulsion vehicles that are coupled together in a group or consist. In an alternative embodiment, at least some of the components of the control system may be located remotely from the vehicle system, such as at a dispatch location. The remote components of the control system may communicate with the vehicle system (and with components of the control system disposed thereon).

The control system may include a communication system 126 that communicates with vehicles in the vehicle system and/or with remote locations, such as a remote (dispatch) location 128, other vehicle systems, etc. The communication system may include a receiver and a transmitter, or a transceiver that performs both receiving and transmitting functions. The communication system may also include an antenna and associated circuitry.

The control system has a controller 130 or control unit that is a hardware and/or software system which operates to perform one or more functions for the vehicle system. The controller receives information from components of the control system, analyzes the received information, and generates operational settings for the vehicle system to control the movements of the vehicle system.

The vehicle system may also include an end of vehicle device 132 that may be coupled to a back end of the last vehicle of the vehicle system. The end of vehicle device may include portions of the communication system 133, including a transceiver 134 disposed therein that is operated by the controller. The end of vehicle device in one example, may include an antenna 136 for receiving communication signals and sending communication signals as described herein. In particular, a matching circuit 135 may be provided to convert communication signals of the transceiver to be communicated by the antenna. In one example, the antenna may be a high gain antenna that has an antenna gain of at least 1.5 dBi. In one example, the antenna gain is in a range between 2 dBi and 5 dBi. The antenna may also have a length in a range between slightly less than half a wave of a communication signal and ⅝s of a wave of a communication signal.

Figure 2:
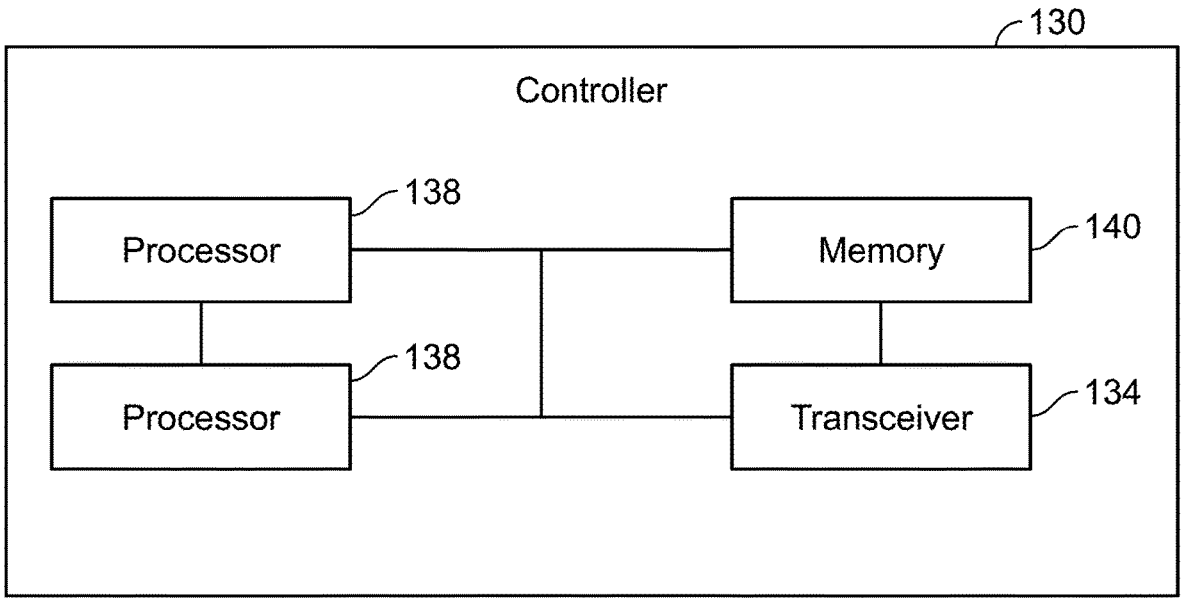
FIG. 2 illustrates a schematic view of a control system.

FIG. 2 provides a schematic illustration of the controller of the control system that may be operable to control communication to and from the transceiver. While in the example embodiment of FIG. 1 the controller is illustrated as associated with a lead vehicle, in other examples, the controller of FIG. 2 may be in the end of vehicle device. To that end, the controller of FIG. 2 may be in an end of vehicle device and communicate with a second controller at the lead vehicle. The controller may include one or more processors 138. Each processor may include a microprocessor or equivalent control circuitry. At least one algorithm may operate within the one or more processors.

The controller optionally may also include a controller memory 140, which is an electronic, computer-readable storage device or medium. The controller memory may be within the housing of the controller, or alternatively may be on a separate device that may be communicatively coupled to the controller and the one or more processors therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The controller memory can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

Optionally, the controller may be configured to communicate at least some operational settings designated by the controller in a communication signal. The communication signal may be related to a sensor reading, including a GPS reading, vehicle parameters such as speed, heading, fuel efficiency, etc., vehicle identification information, or the like. In another example, the control signal may be directed to a user interface device that displays and/or otherwise presents information to a human operator of the vehicle system. In this manner, the controller is operable to cause the communication of the communication signals from an end of vehicle device to the head of the vehicle to an operator. Alternatively, the control may cause communication of the communication signals from an end of vehicle device to a remote location, such as to a dispatch.

Figure 3A:
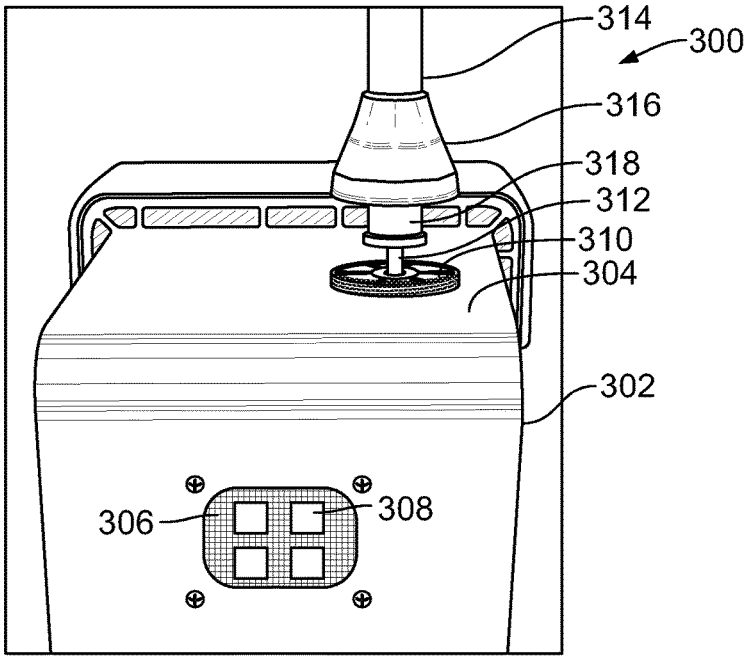
FIG. 3A illustrates a side perspective view of an end of vehicle device.
Figure 3B:
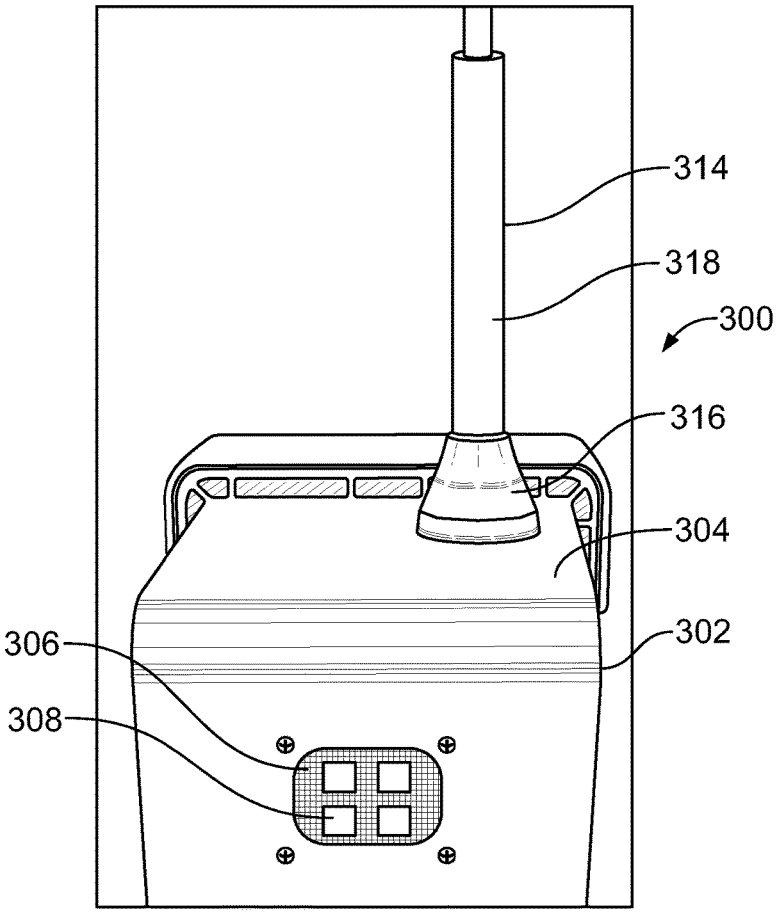
FIG. 3B illustrates a side perspective view of an end of vehicle device.

FIGS. 3A and 3B illustrate side perspective views of an end of vehicle device 300. In one example, the end of vehicle device 300 of FIG. 3 is the end of vehicle device of FIG. 1. The end of vehicle device includes a housing 302 having an exterior 304. The housing may be made of any material, including metal to prevent wear. In one example, the housing has a generally rectangular cross section. In some examples, the end of vehicle device may include a warning light 306 (FIG. 3B), warning sound device (not shown), sensor(s) 308 (FIG. 3B), etc. Similarly, the end of vehicle device may be configured to house a control system, including a controller and transceiver. In one example, the control system and controller are remote from the end of vehicle device, whereas in other examples, the control system and controller are within the end of vehicle device.

The end of vehicle device as illustrated in FIG. 3A includes an opening that receives a threaded coupling disc 310 that includes a coupling element 312. While illustrated as circular, the threaded coupling disc may be other cross section shapes. Similarly, instead of threads, tabs, snap fits, or other mechanical coupling mechanisms may be provided. The coupling element provides a communication path between the transceiver within the end of vehicle device and an antenna 314 that removably couples to the exterior of the end of vehicle device. In particular, a sealing coupling element 316 that includes mating threads that are received by the threads of the threaded coupling disc. In one example, the sealing coupling element may be a retaining nut that when threaded to the coupling disc engages the exterior of the housing to seal the coupling point between the antenna and end of vehicle device. In one example, the sealing coupling element may be made of metal, though alternatively, the coupling element may be plastic, a flexible material such as rubber, or the like. In alternative embodiments, the coupling element may include tab openings, corresponding snap fits, or other corresponding mechanical coupling structure, etc. to provide a removable coupling. By having a removable coupling, the antenna may be quickly coupled to the exterior of the end of vehicle device. In this manner, maintenance or replacement of the antenna is facilitated. The antenna may also include a boot 318 for providing additional strain relief at the base of the antenna. In one example, the boot may be made of a flexible material such as rubber to provide additional strain relief.

Figure 4:
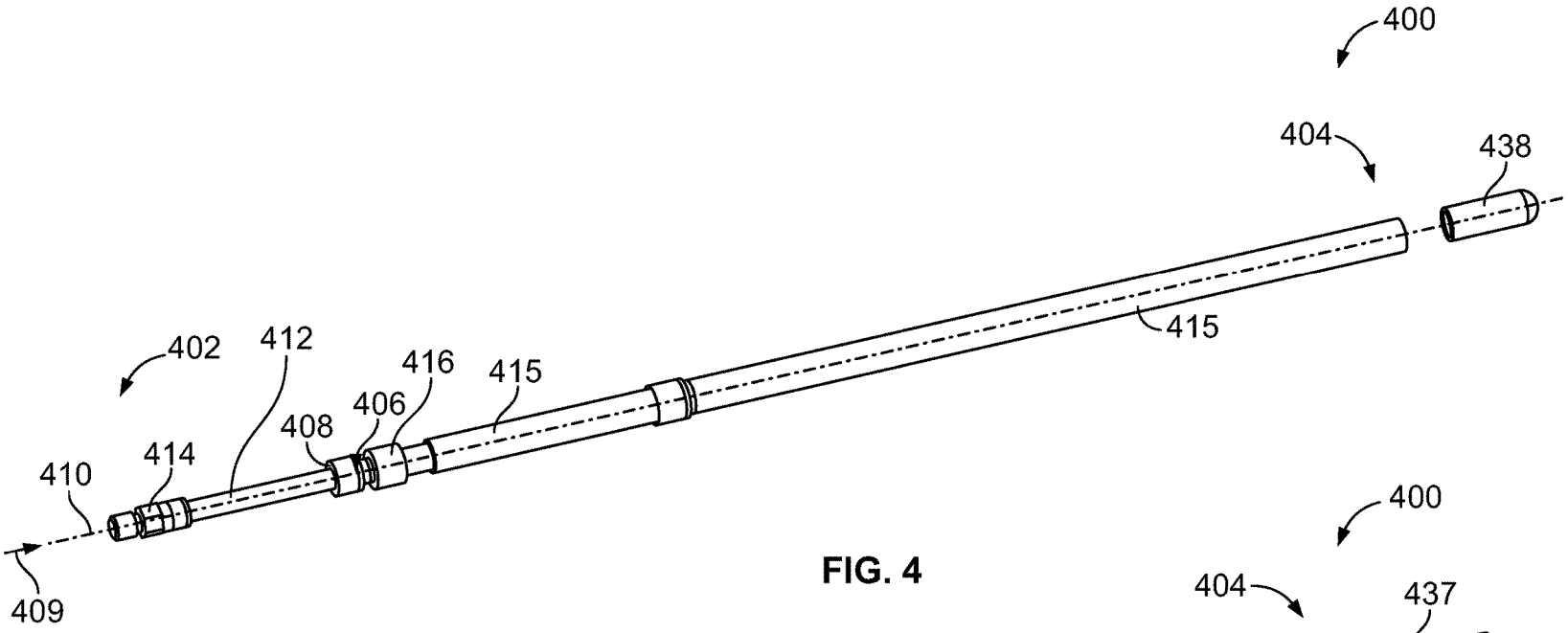
FIG. 4 illustrates an exploded plan side view of an antenna.
Figure 5:
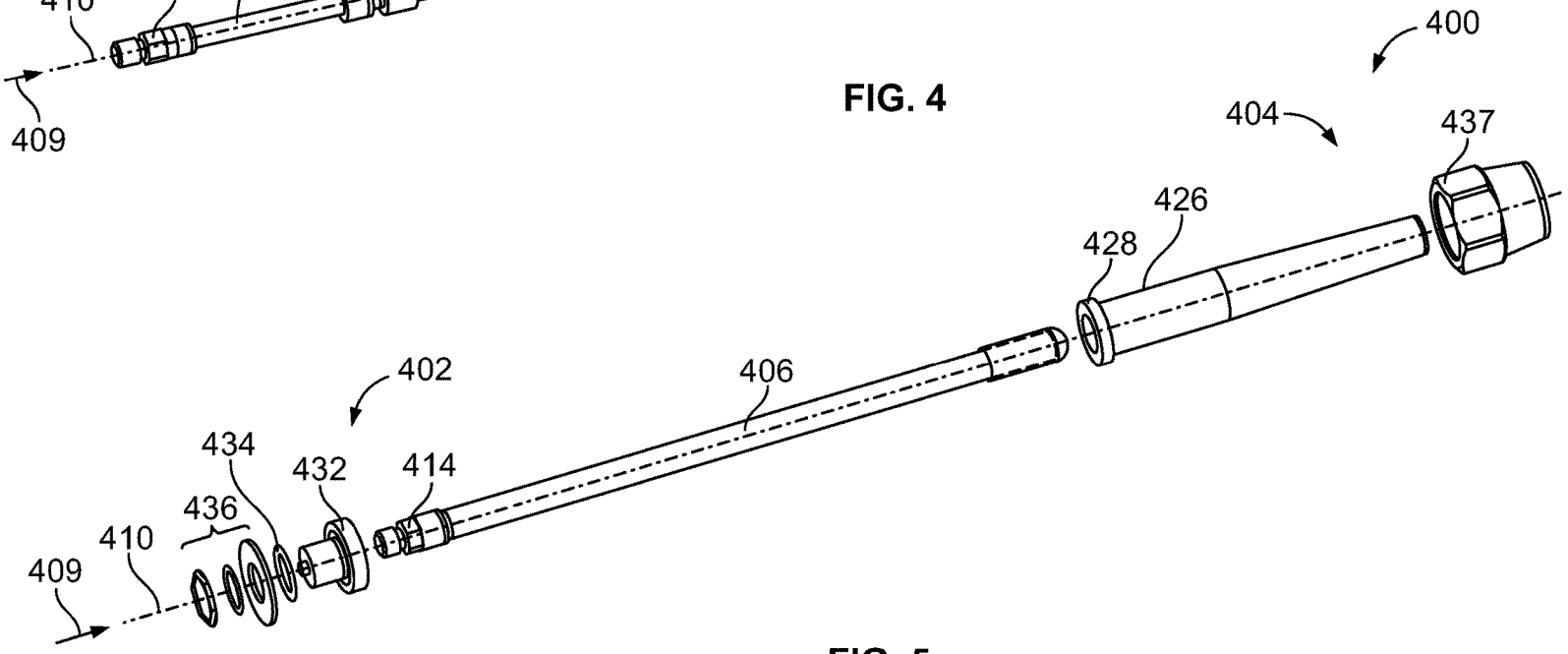
FIG. 5 illustrates an exploded plan side view of an antenna.
Figure 6:
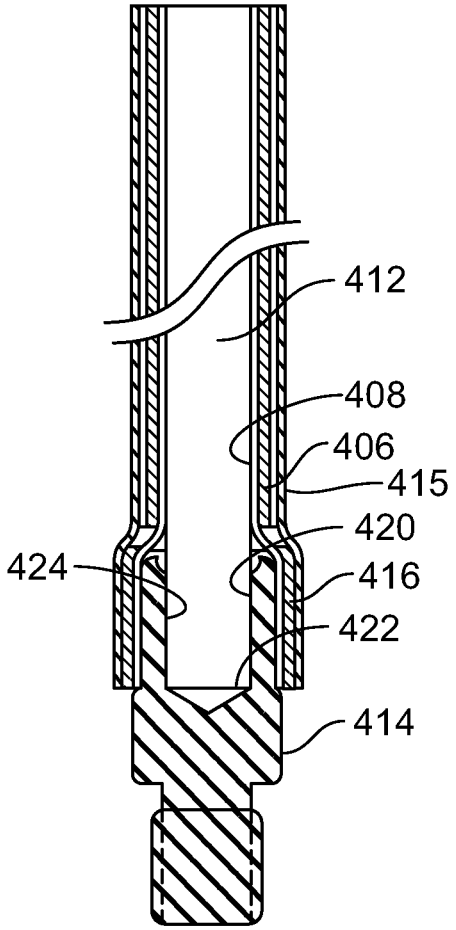
FIG. 6 illustrates a sectional view of an antenna.
Figure 7:
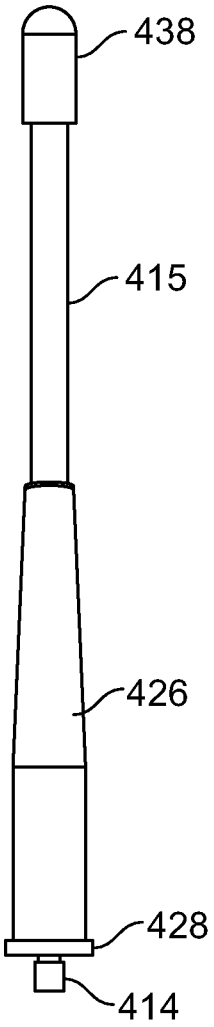
FIG. 7 illustrates a side plan view of an antenna.

FIGS. 4-7 illustrate an example antenna 400, including exploded plan views and side view to show the make-up of the antenna. In one example, the antenna of FIGS. 4-7 is the antenna of any one of FIG. 1, 3A, or 3B. The antenna extends from a first end 402 to a second end 404. The antenna includes a conductive member 406 having a hollow interior 408 (FIG. 4).

In one example, the conductive member 406 may be formed of a copper braid material. By using copper braid as opposed to thin stainless steel or nickel based material, the conductive member 406 may have a larger diameter and resulting higher bandwidth than antenna that use stainless steel or nickel based material. In one example, the nickel based material is included in a composite with titanium. Thus, by using copper braid material instead of steel or nickel based materials, better antenna performance and efficiency may be achieved. In one example the gain of the antenna is in a range between 0 and 20 dBi. In addition, the copper braid may also be more flexible than other metals, also providing an additional advantage.

The conductive member operably couples to a transceiver within the end of vehicle device such that a communication path 409 may extend longitudinally along a center axis 410 of the antenna that is considered the beam axis of the antenna. The communication path is where communication signals to the antenna are received and provided to the transceiver, and are received from the transceiver and sent to locations remote of the end of vehicle device. To this end, the communication signals may be sent to a remote communication device such as a dispatch, or alternatively may be sent to a communication device on-board the vehicle, such as a head of vehicle communication device.

Disposed within the hollow interior of the conductive member may be a flexible support member 412. The flexible support member may be elongated and extend from the first end to the second end. In one example, the flexible support member may be made of one-piece construction, while alternatively, the flexible support member may be made from multi-piece construction. In particular, in a multi-piece construction, the individual portions of the flexible support member may be spaced from one another and still be considered a flexible support member. The flexible support member may directly engage the interior wall of the interior. Alternatively, a secondary cushioning material such as foam, insulation, or the like may be disposed between the flexible support member and the interior wall of the conductive member.

The flexible support member may be formed of plastic, rubber, or the like. In particular, the flexible support member may be made from a material having a modulus of elasticity for Young's modulus of less than 10 GPa. In another example, the modulus of elasticity for Young's modulus is in a range between 0.01 GPa to 0.1 GPa. In another example, the modulus of elasticity for Young's modulus is in a range between 1 GPa and 5 GPa. The flexible support member may be a urethane rubber. In particular, the modulus of elasticity of the flexible support member may be less than the modulus of elasticity of the conductive member. Therefore, where the modulus of elasticity using Young's modulus for the flexible support member may be less than 10 GPa, the modulus of elasticity using Young's modulus for the flexible support member may be greater than 100 GPa such as when copper or another metal is used.

The flexible support member functions to receive force from the conductive member. The force received may be a stress, strain, compressive force, etc. The force may be experienced as a result of the environment of the antenna. In this manner, the force may be applied by wind, bumps, getting hit with debris, getting hit by a worker, etc. The force may be received directly from the conductive member, or passed through an intermediary material. Once the flexible support member receives the force, the flexible support member absorbs and displaces the force along the flexible support member. In particular, the flexible support member flexes to move back and forth. Because the flexible support member receives and absorbs the force from the conductive member, the conductive member may absorb significantly more force before breaking, shearing, bending, deforming, etc. In an experiment an antenna with a conductive member and flexible support member was dropped from ten feet onto concrete without breaking, shearing, bending, deforming, etc. the antenna. The reason the antenna was able to withstand the force of the fall without damage was because the flexible support member effectively absorbed the forces placed on the conductive member.

Because the flexible support member absorbs the forces placed on the conductive member, the conductive member may be made of a material such as copper braid that provides significantly enhanced signal performance over more robust materials such as stainless steel or nickel based materials. Additionally, because the flexible support member extends the length of the conductive member from the first end to the second end, forces experienced all along the conductive member may be absorbed. This is an improvement over a whip-type antenna that may include a flexible base, but may still be damaged by materials and individuals hitting the antenna.

The antenna may also include additional protection. In one example, a heat shrink layer 415 provides additional protection. The heat shrink layer in one example may be a heat shrink tubing that may surround and secure to the exterior of the conductive member. Heat shrink tubing may be a plastic based material that may be secured to the conductive member via heating to provide additional abrasion protection for the conductive member. As a result, a thin protective layer may be formed around the conductive member. To this end, while the flexible support member prevents bending, breaking, and other impact type damage to the conductive member, the heat shrink layer may prevent scratches and other surface damage that may affect performance of the conductive member. Alternatively, plating may be provided. Though, if plated, to prevent radio frequency resistance, the plating may be a metal that has a higher conductivity than copper such as silver, gold, platinum, or the like.

A coupling element 414 may be secured to the conductive member with a fastening device 416. The coupling element may be a fitting that may include a threaded exterior for coupling with corresponding threads in a coupling disc of the end of vehicle device. Alternatively, the coupling element may include snap fits, tabs, other mechanical couplings, or the like, that may include a corresponding coupling element of the end of vehicle device. By using a coupling element such as mating threads, the antenna may be quickly installed and removed. Compared to other high gain antenna that can take over thirty minutes to remove and install, the antenna of this disclosure may be removed and replaced in less than two minutes. Consequently, significant time savings for maintenance and repair is realized.

In one example, the fastening device may be a crimp ring that crimps the conductive element together with the coupling element. Alternatively, other fastening devices may include a press fit, adhesives, or the like may be used to secure the coupling element to the conductive element.

The coupling element may also include a hollow interior 420 (FIG. 6) that forms a cavity that includes an end wall 422 and sidewall 424 that in one example may have a circular cross-section. The flexible support member may be inserted into the cavity to engage the end wall. In one example an adhesive may be used to secure the flexible support member to the sidewall and/or end wall to secure the flexible support member partially within the coupling element.

A boot 426 may be placed over the fastening device and surround the exterior of the conductive member to engage the exterior of the end of vehicle device when the coupling element has been inserted into the end of the vehicle device. The boot may include an arcuate flange 428 extending around a base that may engage an adapter 432. The arcuate flange provides additional stability and transfer of forces for strain relief. In one example, the boot may be flexible, including made of a plastic material, rubber material, etc. The adaptor is provided to provide a coupling between the transceiver and the antenna as needed and also includes an arcuate flange for engaging the arcuate flange of the boot to provide additional strain relief. The adapter in one example is the circular disc of FIG. 2, and provides a coupling at the exterior of an end of vehicle device. In this manner, the adapter may be considered includes as part of the end of vehicle device, or as part of the antenna. A sealing element 434 such as an O-ring, and fastening members 436 such as washers, lock washers, hex nuts, or the like may be provided to provide a secured sealing coupling between the antenna and end of vehicle device to prevent debris, dust, water, or other contaminants from entering the end of vehicle device.

In the embodiment a sealing coupling element 437 may be provided that includes a threaded interior that threads into the periphery of the arcuate flange of the adapter. In one example, the sealing coupling element may be a retaining nut that engages the exterior of the end of vehicle device. Upon engagement of the end of vehicle device, the sealing coupling element provides a seal to prevent debris or other material within the interior of the end of vehicle device. In one example, the sealing coupling member may be made of a metal material, flexible material, etc.

A cap 438 may be provided at the first end of the conductive member. The cap may be made of a flexible material to provide additional protection to the conductive member from water or other environmental contaminants. In addition, the cap functions to prevent individuals from scraping or hurting themselves on a sharp edge of the conductive member.

Figure 8:
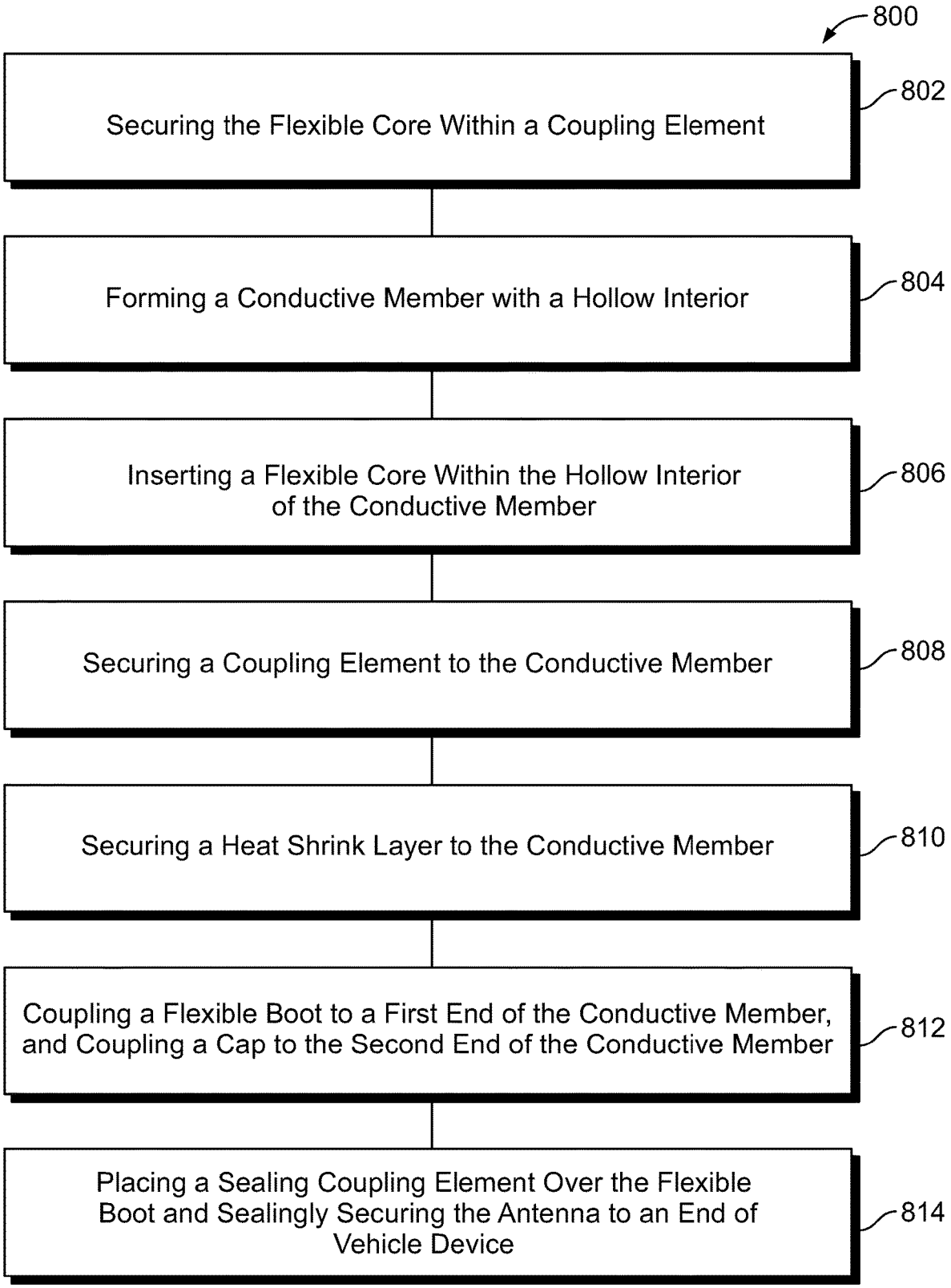
FIG. 8 illustrates a schematic block flow diagram of a process for forming an antenna.

FIG. 8 illustrates a schematic block flow diagram of an example process 800 for forming an antenna. In different examples, the antenna may be the antenna illustrated in any of the previous Figures. The method, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, certain steps may be performed in a different order, or certain steps or series of steps may be re-performed in an iterative fashion. In various embodiments, portions, aspects, and/or variations of the method may be able to be performed in one or more operations described herein.

At 802, the flexible support member is secured within a coupling element. The flexible support member may be formed of rubber, plastic, including urethane, or the like. In one example, the coupling element may be a threaded coupling element. The flexible support member may be inserted into a cavity formed by an interior wall of the coupling element and an end wall. In one example, to secure the flexible support member within the coupling element, adhesive is applied to the portion of the flexible support member within the coupling element. Alternatively, the flexible support member may be secured through a friction fit, fasteners, etc.

At 804, a conductive member with a hollow interior is formed. In one example, the conductive member may be the conductive member as described in relation to FIGS. 4-7. To this end, the conductive member may be configured to provide a gain in a range between 0-20 decibels per isotropic radiator. The conductive member may also be flexible to provide stain relief for the antenna. The conductive member may be formed through an additive process such as three-dimensional printing, by molding, through machining, etc. The conductive member may be formed to have a circular cross-section, a square cross-section, a rectangular cross-section, a triangular cross-section, or the like. Similarly, the hollow interior may be formed through the additive process, through molding, drilling, etc. In one example, the conductive member may be made of a copper braid, and specifically from machining a copper braid. In an example, the conductive member during the formation process may be plated with at least one of silver, gold, or platinum. Specifically, the hollow conductive member may be plated with a material with a higher conductivity than the conductive member material to reduce or prevent radio frequency interference.

At 806, the flexible support member is inserted within the hollow interior of the conductive member. While in one example the flexible support member may be inserted into the hollow interior after the conductive member is formed, in another example, the flexible support member may be inserted within the hollow interior by forming the conductive member around the flexible support member. In another example, inserting the flexible support member within the hollow interior of the conductive member occurs during an additive process where the flexible support member is printed inside of the conductive member.

At 808, a coupling element is secured to the conductive member. The coupling element may be secured to the conductive member with a crimping ring that provides a pressure to the coupling element and conductive member. Alternatively, adhesive, fasteners, friction fit, or the like may secure the coupling element of the conductive member.

At 810, a heat shrink layer is secured to the conductive member. The heat shrink layer may be formed and secured by sliding tubing over the conductive member, and then heating the tubing to adhere the tubing to the conductive layer. The heat shrink layer may be a plastic based material that once heated shrinks to adhere to the conductive member. In one example, two heat shrink layers are applied, a first heat shrink layer that may be applied to the flexible support member, and a second heat shrink layer that may be applied to the conductive member. In this manner, both the flexible support member, and conductive member include additional protection from the environment.

At 812, coupling a flexible boot to a first end of the conductive member, and coupling a cap to the second end of the conductive member. The flexible boot may be friction fit around the conductive member to provide a base portion of the antenna that may sealingly engage an adapter of an end of vehicle device when the antenna is secured to the end of vehicle device. The cap meanwhile may prevent water and other environmental contaminants from harming the antenna during use.

At 814, a sealing coupling element is placed over the flexible boot and sealingly secures the antenna to an end of vehicle device. In one example, the sealing coupling element may be a retaining nut that engages the exterior of the end of vehicle device. Upon engagement of the end of vehicle device, the sealing coupling element provides a seal to prevent debris or other material within the interior of the end of vehicle device. In one example, the sealing coupling member may be made of a metal material, flexible material, etc.

By using the process, forming of the antenna may be facilitated. Additionally, by using the flexible support member, materials for the conductive member may be selected based on antenna performance, ease of manufacturing, etc. improving the antenna and/or the manufacturing process.

In one or more embodiments, a system may be provided that may include a vehicle device. An antenna may be coupled to an exterior of the vehicle device and may be configured to communicate signals to or from the vehicle device. The antenna may include a conductive member configured to communicate the signals to or from the vehicle device, and a flexible support member disposed within the conductive member and configured to receive, absorb, and displace force from the conductive member.

Optionally, the conductive member may comprise copper braid.

Optionally, the flexible support member may comprise one of rubber or plastic.

Optionally, the antenna may comprise a heat shrink layer at least partially surrounding the conductive member.

Optionally, the conductive member may be plated with at least one of silver, gold, or platinum.

Optionally, the antenna may have a gain between zero decibels per isotropic radiator and twenty decibels per isotropic radiator.

Optionally, the antenna may include a coupling element removably coupled within the vehicle device to provide a communication path from the antenna to within the vehicle device. In another aspect, the coupling element may include at least one of threads or a fastener.

Optionally, a flexible boot may be coupled to the conductive member to provide strain relief for the antenna.

In one or more embodiments, a method for forming an antenna may be provided that may include forming a conductive member with a hollow interior. The conductive member may be configured to provide a gain of a communication signal between zero decibels per isotropic radiator and twenty decibels per isotropic radiator. The method may also include inserting a flexible support member within the hollow interior of the conductive member. The flexible support member may be configured to receive, absorb, and displace force from the conductive member.

Optionally, the method may also include crimping a coupling element to the conductive member. The coupling element can be configured to removably couple to an end of vehicle device.

Optionally, the method may also include plating an exterior of the conductive member with at least one of silver, gold, or platinum.

Optionally, the method may also include coupling a flexible boot to a first end of the conductive member, and coupling a cap to a second end of the conductive member.

Optionally, the method may also include securing the heat shrink layer over the conductive member including sliding heat shrink tubing over the conductive member, and heating the heat shrink tubing until the heat shrink tubing forms the heat shrink layer on the conductive member.

In one or more embodiments, a system may include an end of vehicle device that includes a transceiver. The system may also include an antenna coupled to the transceiver and configured to communicate signals of the transceiver to or from the end of vehicle device. The antenna may include a conductive member with a hollow interior that may be configured to communicate the signals to or from the end of vehicle device, and a flexible support member may be disposed within the hollow interior and engaging the conductive member. The modulus of elasticity of the flexible support member may differ from the modulus of elasticity of the conductive member.

Optionally, the end of vehicle device may include a housing with an opening disposed therethrough, and the conductive member may be secured to a coupling element that may be disposed through the opening in the housing.

Optionally, the antenna may include a sealing coupling element sealingly coupling the conductive member to the housing of the end of vehicle device.

Optionally, the antenna may include a matching circuit electrically coupling the transceiver to the antenna.

Optionally, the conductive member may be configured to provide a gain of a communication signal between zero decibels per isotropic radiator and twenty decibels per isotropic radiator.

Optionally, a heat shrink layer may at least partially surround the conductive member.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

an end of vehicle device including a transceiver, wherein the end of vehicle device is configured to be coupled to a back end of a last rail vehicle of a rail vehicle consist; and an antenna coupled to the transceiver and configured to communicate signals of the transceiver between the end of vehicle device and a first rail vehicle of the rail vehicle consist the antenna comprising:

a conductive member with a hollow interior configured to communicate the signals; and a flexible support member disposed within the hollow interior and engaging the conductive member; and wherein a modulus of elasticity of the flexible support member differs from a modulus of elasticity of the conductive member.

2. The system of claim 1, wherein the end of vehicle device includes a housing with an opening disposed therethrough, and the conductive member is secured to a coupling element that is disposed through the opening in the housing.

3. The system of claim 2, comprising a sealing coupling member sealingly coupling the conductive member to the housing of the end of vehicle device.

4. The system of claim 1, comprising a matching circuit within the end of vehicle device and electrically coupling the transceiver to the antenna.

5. The system of claim 1, wherein the conductive member is configured to provide a gain of a communication signal between zero decibels per isotropic radiator and twenty decibels per isotropic radiator.

6. The system of claim 1, comprising a heat shrink layer at least partially surrounding the conductive member.

7. The system of claim 2, wherein the coupling element is removably coupled within the vehicle device.

8. The system of claim 1, wherein:

the end of vehicle device further comprises a housing having an exterior, and a housing coupling element attached to the housing;

the transceiver is disposed inside the housing; and the antenna is removably coupled to the housing coupling element on the exterior of the housing for installation and removal of the antenna from the exterior of the housing.

9. The system of claim 8, wherein:

the antenna further comprises a heat shrink layer at least partially surrounding the conductive member, a conductive antenna coupling element disposed at an end of the antenna and having an antenna coupling element hollow interior in which an end of the flexible support member is received, and a fastening device, wherein the fastening device coaxially fastens the conductive member to an exterior of the antenna coupling element for an electrical connection therebetween, and the antenna coupling element is configured to removably couple the antenna to the housing coupling element that is attached to the housing.

10. A system comprising:

an end of vehicle device including a transceiver, wherein the end of vehicle device is configured to be coupled to a back end of a last rail vehicle of a rail vehicle consist; and an antenna coupled to the transceiver and configured to communicate signals of the transceiver between the end of vehicle device and a first rail vehicle of the rail vehicle consist, the antenna comprising:

a conductive member with a hollow interior configured to communicate the signals; and a flexible support member disposed within the hollow interior and engaging the conductive member;

wherein a modulus of elasticity of the flexible support member differs from a modulus of elasticity of the conductive member; and the antenna is removably coupled to a housing coupling element on an exterior of a housing for installation and removal of the antenna from the exterior of the housing.

11. The system of claim 10, wherein the flexible support member comprises one of rubber or plastic.

12. The system of claim 10, wherein the antenna comprises a heat shrink layer at least partially surrounding the conductive member.

13. The system of claim 10, wherein the conductive member is plated with at least one of silver, gold, or platinum.

14. The system of claim 10, wherein the antenna has a gain between zero decibels per isotropic radiator and twenty decibels per isotropic radiator.

15. The system of claim 10, wherein the antenna has an antenna coupling element includes at least one of threads or a fastener.

16. The system of claim 10, wherein a flexible boot is coupled to the conductive member.

17. A system comprising:

an end of vehicle device including a transceiver, wherein the end of vehicle device is configured to be coupled to a back end of a last rail vehicle of a rail vehicle consist; and an antenna coupled to the transceiver and configured to communicate signals of the transceiver between the end of vehicle device and a first rail vehicle of the rail vehicle consist, the antenna comprising:

a conductive member with a hollow interior configured to communicate the signals; and a flexible support member disposed within the hollow interior and engaging the conductive member;

wherein a modulus of elasticity of the flexible support member differs from a modulus of elasticity of the conductive member; and the antenna further comprises a heat shrink layer at least partially surrounding the conductive member, a conductive antenna coupling element disposed at an end of the antenna and having an antenna coupling element hollow interior in which an end of the flexible support member is received, and a fastening device, wherein the fastening device coaxially fastens the conductive member to an exterior of the antenna coupling element for an electrical connection therebetween, and the antenna coupling element is configured to removably couple the antenna to a housing coupling element that is attached to a housing.

18. The system of claim 17, wherein the antenna has a gain between zero decibels per isotropic radiator and twenty decibels per isotropic radiator.

19. The system of claim 17, wherein the antenna coupling element includes at least one of threads or a fastener.

20. The system of claim 17, wherein a flexible boot is coupled to the conductive member.

* * * * *